US005709577A

United States Patent [19]

Jin et al.

[11] Patent Number: 5,709,577

[45] Date of Patent: Jan. 20, 1998

[54] METHOD OF MAKING FIELD EMISSION DEVICES EMPLOYING ULTRA-FINE DIAMOND PARTICLE EMITTERS

[75] Inventors: Sungho Jin, Millington; Gregory Peter Kochanski, Dunellen; Wei Zhu, North Plainfield, all of N.J.

[73] Assignee: Lucent Technologies Inc., Murray Hill, N.J.

[21] Appl. No.: 361,616

[22] Filed: Dec. 22, 1994

[51] Int. Cl.[6] ..... H01J 1/30

[52] U.S. Cl. ..... 445/24; 445/51; 313/310; 313/336; 313/497

[58] Field of Search ..... 313/495, 497, 313/310, 309, 311, 336, 351; 445/24, 50, 51; 427/77

[56] References Cited

U.S. PATENT DOCUMENTS

| | | | |
|---|---|---|---|
| 4,940,916 | 7/1990 | Borel et al. | 313/306 |
| 5,010,249 | 4/1991 | Nishikawa | 250/306 |
| 5,129,850 | 7/1992 | Kane et al. | 445/24 |
| 5,138,237 | 8/1992 | Kane et al. | 315/349 |
| 5,199,918 | 4/1993 | Kumar | 445/50 |
| 5,258,685 | 11/1993 | Jaskie et al. | 313/336 |
| 5,283,500 | 2/1994 | Kochanski | 315/58 |
| 5,504,385 | 4/1996 | Jin et al. | 313/310 |

FOREIGN PATENT DOCUMENTS

| | | | |
|---|---|---|---|
| A-0 572 777 | 12/1993 | European Pat. Off. | H01J 31/12 |
| A-2 260 641 | 4/1993 | United Kingdom | H01J 1/30 |
| WO 91/05361 | 4/1991 | WIPO | H01J 9/02 |

OTHER PUBLICATIONS

Dec. 1991 issue of *Semiconductor International*, p. 46 & Flat Panel Displays: What's All the Fuss About?

C. A. Spidt et al. "Field–Emiter Arrays for Vacuum Microelectronics," *IEEE Transactions on Electron Devices*, vol. 38, pp. 2355–2363 (1991), No. 10, Oct. 1991.

I. Brodie and C.A. Spindt, *Advances in Electronics and Electron Physics* edited by P. W. Hawkes, vol. 83, pp. 75–87 (1992).

J. A. Costellano, *Handbook of Display Technology* Academic Press, NY, pp. 254–257 (1992).

Okano et al., "Fabrication of a diamond field emitter array", *Appl. Phys. Lett*, vol. 64, p. 2742 (1994), No. 20.

S. Katsumata et al. "Patterning of CVD Diamond Films by Seeding And Their Field Emission Properties" *Diamond And Related Maerials*, vol. 3, No. 11/12 pp. 1296–1300 (1994) Nov.

*Primary Examiner*—Sandra L. O'Shea
*Assistant Examiner*—Matthew J. Esserman
*Attorney, Agent, or Firm*—Glen E. Books; Robert E. Rudnick

[57] ABSTRACT

Applicants have discovered methods for making electron emitters using commercially available diamond particles treated to enhance their capability for electron emission under extremely low electric fields. Specifically, applicants have discovered that electron emitters comprising ultra-fine (5–10,000 nm) diamond particles heat-treated by a hydrogen plasma, can produce electron emission current density of at least 0.1 mA/mm$^2$ at extremely low electric fields of 0.5–1.5 V/μm. These field values are about an order of magnitude lower than exhibited by the best defective CVD diamond and almost two orders of magnitude lower than p-type semiconducting diamond. Emitters are preferably fabricated by suspending the ultra-fine diamond particles, preferably in the nanometer size range, in an aqueous solution, applying the suspension as a coating onto a conducting substrate such as n-type Si or metal, and then subjecting the coated substrate to a plasma of hydrogen, preferably at temperatures above 300° C. for a period of 30 minutes or longer. The resulting emitters show excellent emission properties such as extremely low turn-on voltage, good uniformity and high current densities. It is further found that the emission characteristics remain the same even after the plasma treated diamond surface is exposed to air for several months.

12 Claims, 4 Drawing Sheets

METHOD OF MAKING FIELD EMISSION DEVICES EMPLOYING ULTRA-FINE DIAMOND PARTICLE EMITTERS

FIELD OF THE INVENTION

This invention pertains to field emission devices and, in particular, to field emission devices, such as flat panel displays, using ultra-fine diamond particle material with enhanced electron emission characteristics.

BACKGROUND OF THE INVENTION

Field emission of electrons into vacuum from suitable cathode materials is currently the most promising source of electrons in vacuum devices. These devices include flat panel displays, klystrons and travelling wave tubes used in microwave power amplifiers, ion guns, electron beam lithography, high energy accelerators, free electron lasers, and electron microscopes and microprobes. The most promising application is the use of field emitters in thin matrix-addressed flat panel displays. See, for example, the December 1991 issue of *Semiconductor International,* p.46; C. A. Spindt et at., *IEEE Transactions on Electron Devices,* vol. 38, p. 2355 (1991); I. Brodie and C. A. Spindt, *Advances in Electronics and Electron Physics,* edited by P. W. Hawkes, vol. 83, pp. 75–87 (1992); and J. A. Costellano, *Handbook of Display Technology,* Academic Press, New York, pp. 254 (1992), all of which are incorporated herein by reference.

A typical field emission device comprises a cathode including a plurality of field emitter tips and an anode spaced from the cathode. A voltage applied between the anode and cathode induces the emission of electrons towards the anode.

A conventional electron field emission flat panel display comprises a flat vacuum cell having a matrix array of microscopic field emitters formed on a cathode of the cell (the back plate) and a phosphor coated anode on a transparent front plate. Between cathode and anode is a conductive element called a grid or gate. The cathodes and gates are typically intersecting strips (usually perpendicular strips) whose intersections define pixels for the display. A given pixel is activated by applying voltage between the cathode conductor strip and the gate conductor. A more positive voltage is applied to the anode in order to impart a relatively high energy (400–3,000 eV) to the emitted electrons. See, for example, U.S. Pat. Nos. 4,940,916; 5,129,850; 5,138,237 and 5,283,500, each of which is incorporated herein by reference.

Ideally, the cathode materials useful for field emission devices should have the following advantageous characteristics:

(i) The emission current is advantageously voltage controllable, preferably with drive voltages in a range obtainable from off-the-shelf integrated circuits. For typical device dimensions (1 μm gate-to-cathode spacing), a cathode that emits at fields of 25 V/μm or less is suitable for typical CMOS circuitry.

(ii) The emitting current density is advantageously in the range of 0.1–1 mA/mm$^2$ for flat panel display applications.

(iii) The emission characteristics are advantageously reproducible from one source to another, and advantageously stable over a very long period of time (tens of thousands of hours).

(iv) The emission fluctuations (noise) is advantageously small so as not to limit device performance.

(v) The cathode is advantageously resistant to unwanted occurrences in the vacuum environment, such as ion bombardment, chemical reaction with residual gases, temperature extremes, and arcing; and (vi) The cathode manufacturing is advantageously inexpensive, without highly critical processes and adaptable to a wide variety of applications.

Previous electron emitters were typically made of metal (such as Mo) or semiconductor (such as Si) with sharp tips in nanometer sizes. Reasonable emission characteristics with stability and reproducibility necessary for practical applications have been demonstrated. However, the control voltage required for emission from these materials is relatively high (around 100 V) because of their high work functions. The high voltage operation increases the damaging instabilities due to ion bombardment and surface diffusion on the emitter tips and necessitates high power densities to be supplied from an external source to produce the required emission current density. The fabrication of uniform sharp tips is difficult, tedious and expensive, especially over a large area. In addition, the vulnerability of these materials to ion bombardment, chemically active species and temperature extremes is a serious concern.

Diamond is a desirable material for field emitters because of its negative electron affinity and robust mechanical and chemical properties. Field emission devices employing diamond field emitters are disclosed, for example, in U.S. Pat. Nos. 5,129,850 and 5,138,237 and in Okano et al., *Appl. Phys. Lett.,* vol. 64, p. 2742 (1994), all of which are incorporated herein by reference. Flat panel displays which can employ diamond emitters are disclosed in co-pending U.S. patent application Ser. No. 08/220,077 filed by Eom et al on Mar. 30, 1994, U.S. patent applications Ser. No. 08/299,674 and Ser. No. 08/299,470, both filed by Jin et al. on Aug. 31, 1994, and U.S. patent applications Ser. No. 08/331,458 and Ser. No. 08/332,179, both filed by Jin et al. on Oct. 31, 1994. These five applications are incorporated herein by reference.

While diamond offers substantial advantages for field emitters, there is a need for diamond emitters capable of emission at yet lower voltages. For example, flat panel displays typically require current densities of at least 0.1 mA/mm$^2$. If such densities can be achieved with an applied voltage below 25 V/μm for the gap between the emitters and the gate, then low cost CMOS driver circuitry can be used in the display. Unfortunately, good quality, intrinsic diamond cannot emit electrons in a stable fashion because of its insulating nature. Therefore, to effectively take advantage of the negative electron affinity of diamond to achieve low voltage emission, diamonds were conventionally doped into n-type semiconductivity. But the n-type doping process has not been reliably achieved for diamond. Although p-type semiconducting diamond is readily available, it is not helpful for low voltage emission because the energy levels filled with electrons are much below the vacuum level in p-type diamond. Typically, a field of more than 70 V/μm is needed for p-type semiconducting diamond to generate an emission current density of 0.1 mA/mm$^2$.

An alternative method to achieve low voltage field emission from diamond is to grow or treat diamond so that the densities of defects are increased in the diamond structure, as disclosed in pending U.S. patent application Ser. No. 08/331,458 filed by Jin et al. on Oct. 31, 1994. Such defect-rich diamond typically exhibits a full width at half maximum (FWHM) of 7–11 cm$^{-1}$ for the diamond peak at 1332 cm$^{-1}$ in Raman spectroscopy, and the electric field required to produce an electron emission current density of 0.1 mA/mm$^2$ from these diamonds can reach as low as 12 V/μm.

SUMMARY OF THE INVENTION

Applicants have discovered methods for making electron emitters using commercially available diamond particles treated to enhance their capability for electron emission under extremely low electric fields. Specifically, applicants have discovered that electron emitters comprising ultra-fine (5–10,000 nm) diamond particles heat-treated by a hydrogen plasma, can produce electron emission current density of at least 0.1 mA/mm$^2$ at extremely low electric fields of 0.5–5.0 V/μm. These field values are as much as an order of magnitude lower than exhibited by the best defective CVD diamond and as much as two orders of magnitude lower than p-type semiconducting diamond. Emitters are preferably fabricated by suspending the ultra-fine diamond particles, preferably in the nanometer size range, in an aqueous solution, applying the suspension as a coating onto a conducting substrate such as n-type conductive Si or metal, and then subjecting the coated substrate to a plasma of hydrogen preferably at temperatures above 300° C. for a period of 30 minutes or longer. The resulting emitters show excellent emission properties such as extremely low turn-on voltage, good uniformity and high current densities. It is further found that the emission characteristics remain the same even after the plasma treated diamond surface is exposed to air for several months.

BRIEF DESCRIPTION OF THE DRAWINGS

The nature, advantages and various additional features of the invention will appear more fully upon consideration of the illustrative embodiments now to be described in detail in connection with the accompanying drawings. In the drawings.

It is to be understood that the drawings are for purposes of illustrating the concepts of the invention and, except for graphical illustrations, are not to scale.

DETAILED DESCRIPTION

Figure 1:
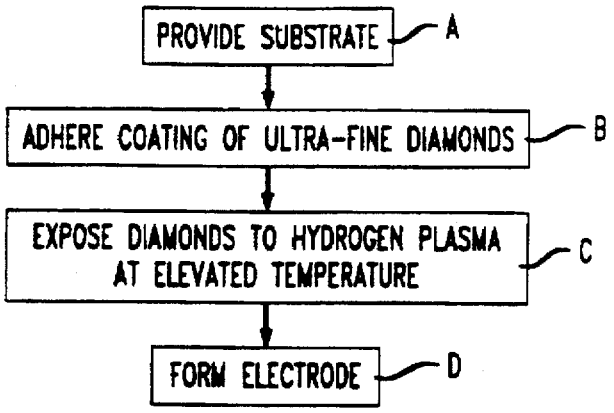
FIG. 1 is a flow diagram of a preferred process for making a field emission device in accordance with the invention.

Referring to the drawings, FIG. 1 illustrates the steps to prepare a low voltage field emitter structure. The first step shown in block A of FIG. 1 is to provide a substrate. The substrate can be metal, semiconductor or conductive oxide. It can also be insulating in the event conductive material is subsequently applied. For many substrates, especially oxides, it is advantageous before diamond deposition to deposit a protective layer of a material that is not readily etched by hydrogen plasma. For example, a layer of 100 nm or less of silicon can prevent reactions between hydrogen and the substrate.

The next step shown in block B is to adhere to the substrate a thin coating of ultra-fine diamond particles having maximum dimensions in the range of 5 to 10,000 nm. Ultra-fine diamond particles are desired not only because of emission voltage-lowering defects but also because the small radius of curvature tends to concentrate the electric field. In addition, small dimensions reduce the path length which electrons must travel in the diamond and simplify construction of the emitter-gate structure. Such ultra-fine particles, typically having maximum dimensions in the range of 5 nm to 1,000 nm, and preferably 10 nm to 300 nm size, can be prepared by a number of methods. For example, a high temperature, high pressure synthesis technique (explosive technique) is used by E. I. Dupont to manufacture nanometer diamond particles sold under the product name Mypolex. The ultra-fine diamond particles may also be prepared by low pressure chemical vapor deposition, precipitation from a supersaturated solution, or by mechanical or shock-induced pulverization of large diamond particles. The diamonds are desirably uniform in size, and preferably 90% by volume have maximum dimensions between ⅓ the average and 3 times the average.

The preferred method for coating the substrate is to suspend the diamond particles in a carrier liquid and apply the mixture to the substrate. The diamond particles are advantageously suspended in water or other liquid such as alcohol or acetone (and optionally with charged surface adherent surfactants) in order to avoid agglomeration of fine particles and for easy application on flat substrate surfaces. The suspension permits application of thin, uniform coatings of diamond particles in a convenient manner such as by spray coating, spin coating, sol gel method, or electrophoresis. The coating desirably has a thickness less than 10 μm, preferably less than 1 μm and more preferably, is only one layer of particles where the diamond covers 1% to 90% of the surface.

It is desirable to minimize the thermal expansion mismatch between the diamond particles and the conductive substrate for the sake of adhesion between the two. Desirably, the two thermal expansion coefficients are within a factor of 10 and preferably less than a factor of 6. For substrates whose thermal expansion substantially differs from diamond (e.g. glass or tantalum) it is advantageous for the deposited film to be less than three times the thickness of a monolayer and preferably to be a single monolayer with 1% to 60% coverage. Either the emitter layer, surface of the conductive substrate or both, are typically patterned into a desirable emitter structure such as a pattern of rows or columns so that emission occurs only from the desired regions. The carrier liquid is then allowed to evaporate or to burn off during subsequent plasma processing.

Instead of suspension, the ultra-fine diamond particles can also be mixed with conductive particles such as elemental metals or alloys like solder particles together with solvents and optionally binders (to be pyrolized later) to form a slurry. In this case, the substrate can be non-conductive and the mixture can be screen printed or dispersed onto the substrate through a nozzle using the known techniques to form a desired emitter pattern. The solder (especially the low melting temperature type such as Sn, In, Sn—In, Sn—Bi, or Pb—Sn) can be melted to further enhance the adhesion of the diamond particles and allow easy electrical conduction to the emitter tips. Alternatively, instead of using a suspension or slurry, dry diamond particles can be placed in the surface of a conductor-covered substrate by electrostatic deposition, by electrophoresis or by sprinkling. The diamond particles can then be secured to the surface either by physical embedding into soft conductor layers or by chemical bonding onto the conductor.

The conductive layer on the surface of the substrate can be either metallic or semiconducting. It is advantageous, for the sake of improved adhesion of the diamond particles, to make the conductive layer with materials containing carbide-forming elements or the combinations, e.g., Si, Mo, W, Nb, Ti, Ta, Cr, Zr, or Hr. Alloys of these elements with high conductivity metals such as copper are particularly advantageous.

The conductive layer can consist of multiple layers or steps, and one or more of the uppermost layers of the conductive material can be discontinuous. Optionally, for the sake of improving the uniformity of emission, potions of the conductive layer away from the high-conductivity diamond particle-substrate interface can be etched away or otherwise treated to increase the impedance of these portions. Depending on the specific materials and processing conditions, field emitters can be undesirably non-uniform with pixel-to-pixel variation in display quality. In order to substantially improve display uniformity, it is desirable to add electrical impedance in series with each pixel and/or each emitter, thus limiting the emission current from the best field emitting particles. This permits other emitter sites to share in the emission and provides a more uniform display. Typical resistivity of the uppermost continuous conductive surface on which the ultrafine diamond emitters are adhered is desirably at least 1 mΩ·cm and preferably at least 1Ω·cm. The resistivity is desirably less than 10KΩ·cm. In terms of surface resistivity, when measured on a scale greater than the inter-particle distance, the conductive surface has surface resistance typically greater than 1MΩ/square and preferably greater than 100MΩ/square.

The third step, shown in block C of FIG. 1, is to activate the diamond particles by exposing them to hydrogen plasma. The coated substrates (after drying, if necessary) are loaded into a vacuum chamber for treatment with hydrogen plasma at elevated temperature. The plasma consists predominantly of hydrogen, but it can also include a small amount of other elements,. for example, carbon at less than 0.5 atomic percent and preferably less than 0.1 atomic percent. The substrates are typically exposed to the plasma at a temperature in excess of 300° C., preferably in excess of 400° C. and even more preferably in excess of 500° C. for a period sufficient to produce a device having an electron emission current density of at least 0.1 mA/mm$^2$ at a field strength below 12 V/μm. This period typically exceeds 30 minutes for T=300° C., and diamond film thickness less than 1 μm, but can be less for higher temperatures or thinner films.

Figure 2:
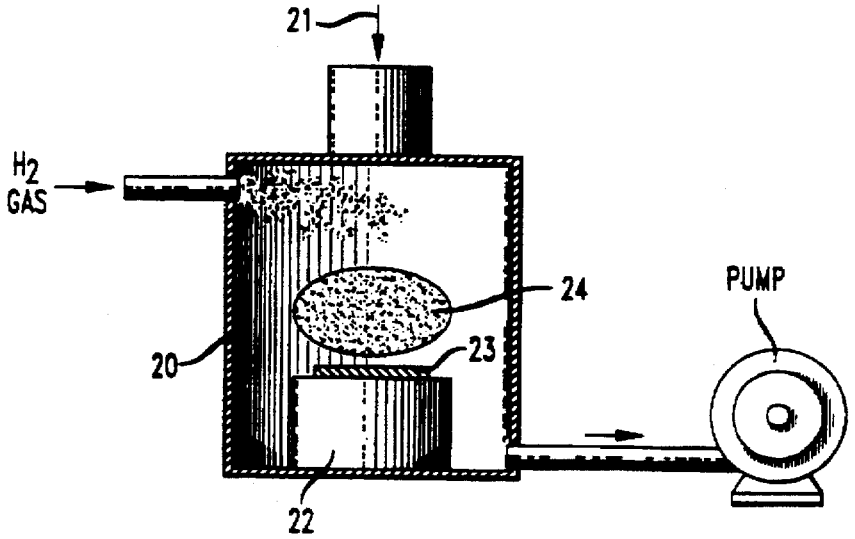
FIG. 2 is a schematic diagram of apparatus useful in the process of FIG. 1.

FIG. 2 schematically illustrates apparatus useful for activating the diamond particles comprising a vacuum chamber 20 equipped with a microwave source 21 and a heater 22. The coated substrate 23 can be placed on the heater 22. A hydrogen plasma 24 (preferably of pure hydrogen gas) was ignited by the microwave energy and formed above the substrate. The substrate temperature is preferably kept above 300° C. and even more preferably above 500° C. for the sake of process kinetics and efficiency but below 1,000° C. for convenience. The typical plasma parameters include a microwave power input of 1 kW and a pressure of 10–100 torr. The duration of such a heat treatment is typically in the range of 1 min. to 100 hours and preferably 10 minutes–12 hours depending on the temperature and thickness of the diamond film.

The microwave plasma can be replaced by a plasma or arc excited by radio frequency (rf) or direct current (dc). Other means of creating a source of activated atomic hydrogen such as using hot filaments of tungsten or tantalum heated to above 2,000° C., rf or dc plasma torch or jet, and combustion flame can also be utilized.

Figure 3:
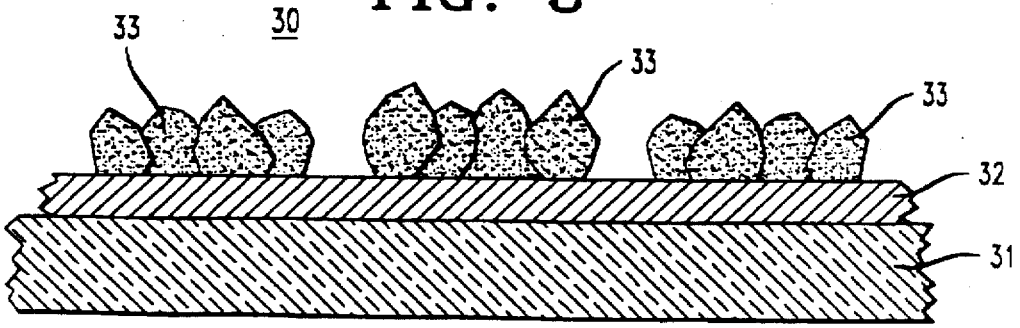
FIG. 3 illustrates the structure formed after the plasma processing step in the process of FIG. 1.

FIG. 3 shows the resulting field emitter 30 comprising a substrate 31 having a conductive surface 32 having a plurality of activated ultra-fine diamond emitter particles 33 attached thereto. For display applications, emitter material (the cold cathode) in each pixel of the display desirably consists of multiple emitters for the purpose, among others, of averaging out the emission characteristics and ensuring uniformity in display quality. Because of the ultra-fine nature of the diamond particles, the emitter 30 provides many emitting points, typically more than $10^4$ emitting tips per pixel of 100 μm×100 μm size assuming 10% area coverage and 10% activated emitters from 100 nm sized diamond particles. The preferred emitter density in the invention is at least 1/μm$^2$ and more preferably at least 5/μm$^2$ and even more preferably at least 20/μm$^2$. Since efficient electron emission at low applied voltages is typically achieved by the presence of accelerating gate electrode in close proximity (typically about 1 micron distance), it is desirable to have multiple gate aperture over a given emitter body to maximally utilize the capability of multiple emitters. It is also desirable to have a fine-scale, micron-sized gate structure with as many gate apertures as possible for maximum emission efficiency.

Figure 4:
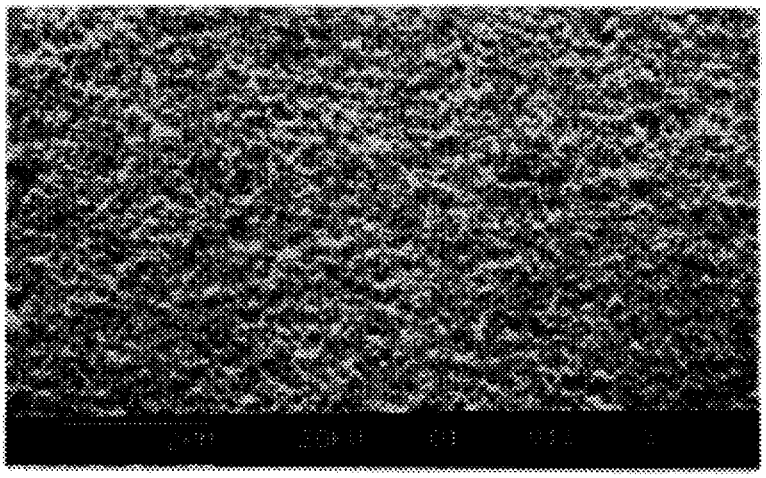
FIGS. 4 and 5 are SEM and TEM micrographs of ultra-fine diamond coatings of the type used in the device of FIG. 3.
Figure 5:
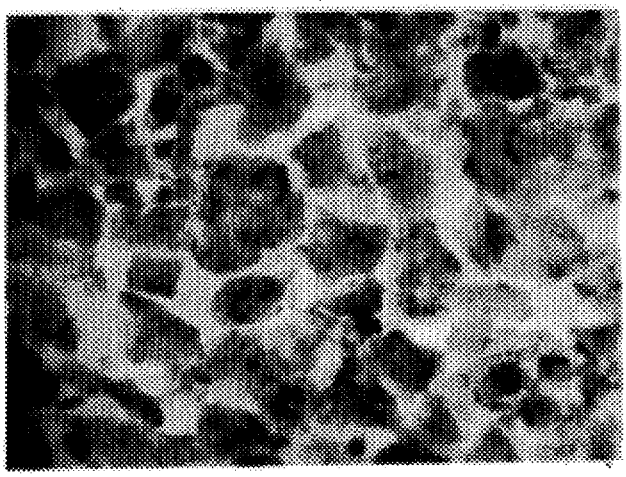
Figure 6:
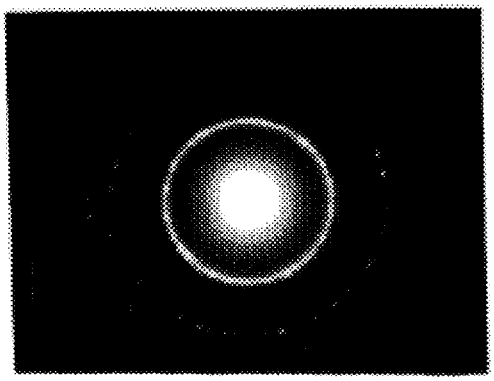
FIG. 6 is an electron diffraction pattern of an ultra-fine diamond coating of the type used in the device of FIG. 3.

FIGS. 4 and 5 show both SEM and TEM micrographs of a plasma treated ultra-fine diamond coating with particle sizes in the range of 50–100 nm. The electron diffraction pattern in FIG. 6 clearly indicates that the coating is composed of diamond phase with no indication of the presence of any significant amount of nondiamond phases such as graphite or amorphous carbon phases. However, the diffraction methods are not sensitive to the presence of minor components of graphitic and amorphous carbon phases in a predominantly crystalline diamond structure. Actually, any ultra-fine materials are expected to contain structural defects. For diamond, one of the typical types of defects is graphitic or amorphous carbon phases. Other defects include point defects such as vacancies, line defects such as dislocations and planar defects such as twins and stacking faults.

The presence of large amounts of non-diamond phases such as graphitic or amorphous material is undesirable, as they are prone to disintegration during emitter operation and are eventually deposited on other parts of the display as soot or particulates. Although the exact amount of the graphitic or amorphous impurities in these ultra-fine diamond particles are not known, the low voltage emitting diamond particles in the present invention have a predominantly diamond structure with typically less than 10 volume percent, preferably less than 2 volume percent and even more preferably less than 1 volume percent of graphitic or amorphous carbon phases within 5 nm of the surface. This predominantly diamond composition is also consistent with the fact that graphite or amorphous carbon is etched away by a hydrogen plasma processing such as described here. The pre-existing graphitic or amorphous carbon regions in the particles would be expected to be preferentially etched away, especially at the surface where the electrons are emitted, resulting in a more complete diamond crystal structure.

Figure 7:
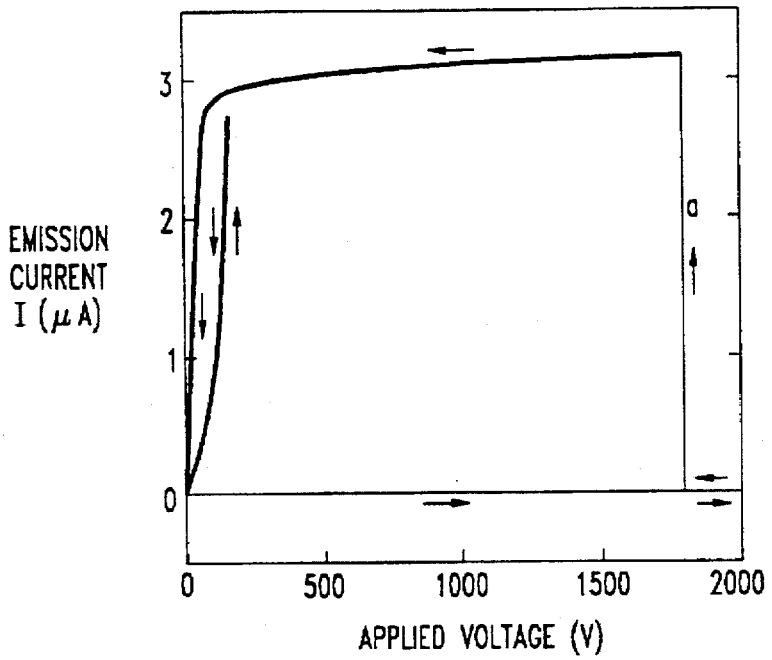
FIG. 7 shows experimentally measured curves of electron emission current vs. voltage for ultra-fine diamond before heat treatment (curve a) and after heat treatment at 875° C. in hydrogen plasma for 4 hours (curve b)

FIG. 7 shows experimentally measured emission I–V curves for untreated diamonds (curve a) and plasma treated diamonds (curve b). The voltage was cycled by rising from zero to the maximum (+2,000V) and then decreasing to zero.

The ultra-fine diamond, with no plasma treatment, showed no electron emission except an arc that formed when the anode probe was moved very close (3.31 μm in this case) to the diamond surface (curve a). This was indicative of an undesirable electrical breakdown of the surface under the intense electric field from the probe. Accompanying the arc, the surface of the diamond coating was damaged and craters were created by evaporation of the diamond. This electrical breakdown is believed to be due to the insulating nature of the untreated diamond particles and poor contacts between particle and particle as well as between particle and substrate.

However, when the diamond coating was treated in a hydrogen plasma at 875° C. for 4 hours, a characteristic Fowler-Nordheim emission I–V curve was obtained (curve b). The current varied smoothly and consistently with the voltage and in a reproducible manner, indicating sufficient conductivity of the coating. Calculations of the field required to yield an emission current density of 0.1 mA/mm$^2$ based on curve fitting of the classic Fowler-Nordheim equation gave a value of 0.5 V/μm for this particular material. This represents a dramatic reduction of the field required for p-type diamond (typically 70 V/μm) and defective diamond (typically 10–20 V/μm). Reproducibility tests of the emission characteristics from different locations of the same sample and from other similarly treated samples consistently yield a field between 0.5–1.5 V/μm for a current density of 0.1 mA/mm$^2$. The diamond particles processed in accordance with the invention emit electrons typically at fields below about 12 V/μm, more typically below about 5 V/μm, and preferably below about 1.5 V/μm.

Surprisingly, the plasma treated surface of the nanometer diamond coating was very stable with respect to the emission characteristics which is insensitive to the exposure to air. When a sample was exposed to air for weeks and even months after the high temperature plasma treatment, it exhibited the same emission behavior just as a freshly plasma-treated diamond sample. This suggests that the plasma treated surface diamond surface is chemically quite inert. However, when the plasma treated surface was subject to bombardment by energetic ions such as 400 eV hydrogen ions, the emission was essentially suppressed, and the diamond behaved similarly as an untreated coating. It is believed that the ion bombardment damaged the features on the surfaces of the plasma heat-treated diamond particles which are responsible for the emission. These surface features possibly include the hydrogen termination of the carbon bonds, but the exact nature is not clearly understood at the present time.

Table I compares the field data from ultra-fine diamond particle coatings treated under various conditions.

TABLE I

Ultra-fine diamond particle samples treated under different conditions and their corresponding field required for emission.

| Samples (all applied on n-type Si substrates) | Typical field (V/μm) required to produce an emission current density of 0.1 mA/mm$^2$ |
|---|---|
| Untreated sample | electric arc and surface damage |
| treated in flowing $H_2$ gas at 500° C. for 30 minutes | electric arc and surface damage |
| treated in flowing $H_2$ gas at 870° C. for 1 hour | electric arc and surface damage |

TABLE I-continued

Ultra-fine diamond particle samples treated under different conditions and their corresponding field required for emission.

| Samples (all applied on n-type Si substrates) | Typical field (V/μm) required to produce an emission current density of 0.1 mA/mm$^2$ |
|---|---|
| treated in $H_2$ plasma at 450° C. for 48 hours | 7.2 |
| treated in $H_2$ plasma at 830° C. for 1 hour | 1.4 |
| treated in $H_2$ plasma at 900° C. for 3 hours | 1.3 |
| treated in $H_2$ plasma at 875° C. for 10 hours | 0.5–1.4 |

Obviously, both an activated hydrogen environment (plasma) and elevated temperatures are preferable for effectively treating the ultra-fine diamond particles for electron emission at low fields. Heat treatments performed in an unactivated hydrogen gas did not produce electron emission, and plasma treatment at lower temperatures resulted in a relatively higher field. The plasma exposure is preferably at a temperature T≧300° C. and more preferably T≧400° C. for a period preferably t>30 mins.

While the exact role of the plasma treatment is not completely understood, it is believed that the hydrogen plasma cleans the diamond surface by removing carbonaceous and oxygen or nitrogen related contaminants and possibly introduce hydrogen-terminated diamond surface with low or negative electron affinity. The hydrogen plasma also removes any graphitic or amorphous carbon phases present on the surface and along the grain boundaries. In addition, treatment improves contacts among the particles and between the particles and the substrate, thus increasing the bulk as well as the surface conductivity. Such conductive contacts are very important to sustain a stable electron emission process. The structure of the nanometer diamond particles is believed to be defective containing various types of bulk structural defects such as vacancies, dislocations, stacking faults, twins and impurities such as graphitic or amorphous carbon phase. When the concentrations of these defects are high, they can form energy bands within the bandgap of diamond and contribute to the electron emission at low electrical fields.

The final step in making an electron field emitting device as shown in block D of PIG. 1 is forming an electrode which can be used to excite emission adjacent the diamond layer. Advantageously this electrode is a high density apertured gate structure such as described in applicants' co-pending patent application Ser. No. 08/299,674. The combination of ultrafine diamond emitters with a high density gate aperture structure is particularly desirable with submicron emitters. Such a high density gate aperture structure can be conveniently achieved by utilizing micron or submicron sized particle masks. After the ultrafine diamond particle emitters are adhered to the conductive substrate surface and activated by hydrogen plasma, mask particles (metal, ceramic or plastic particles typically having maximum dimensions less than 5 μm and preferably less than 1 μm) are applied to the diamond emitter surface as by spraying or sprinkling. A dielectric film layer such as $SiO_2$ or glass is deposited over the mask particles as by evaporation or sputtering. A conductive layer such as Cu or Cr is deposited on the dielectric. Because of the shadow effect, the emitter areas underneath each mask particle have no dielectric film. The mask particles are then easily brushed or blown away, leaving a gate electrode having a high density of apertures.

Figure 8:
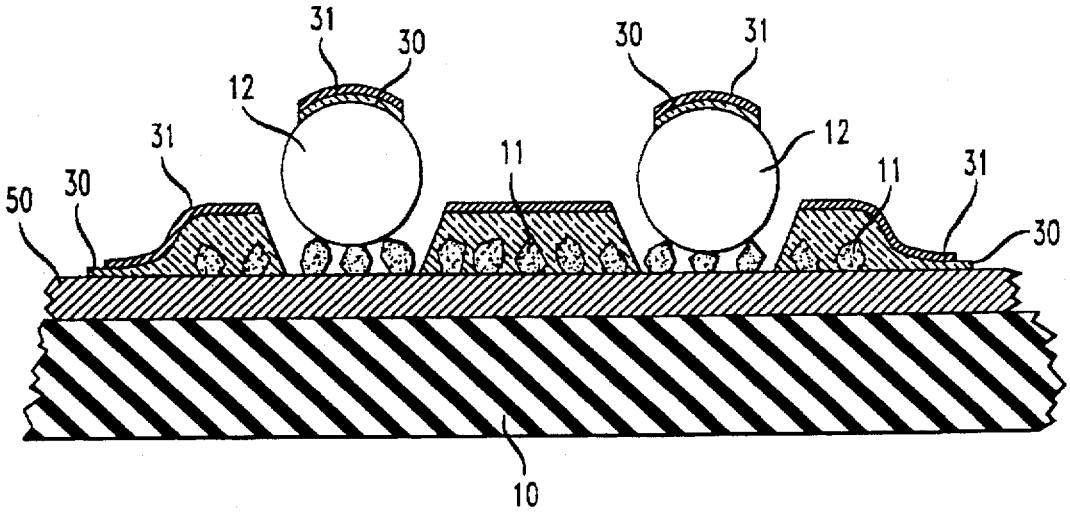
FIG. 8 is a schematic cross section of a field emitting device in the late stages of fabrication.

FIG. 8 illustrates the structure prior to the removal of masking particles 12. The emitter layer of activated diamond particles 11 is adhered on conductive layer 50 on substrate 10 for providing current to the emitters. Dielectric layer 30 insulates emitters 11 from apertured gate electrode 31 except in those regions covered by mask particles 12. Removal of the mask particles completes the device.

Figure 9:
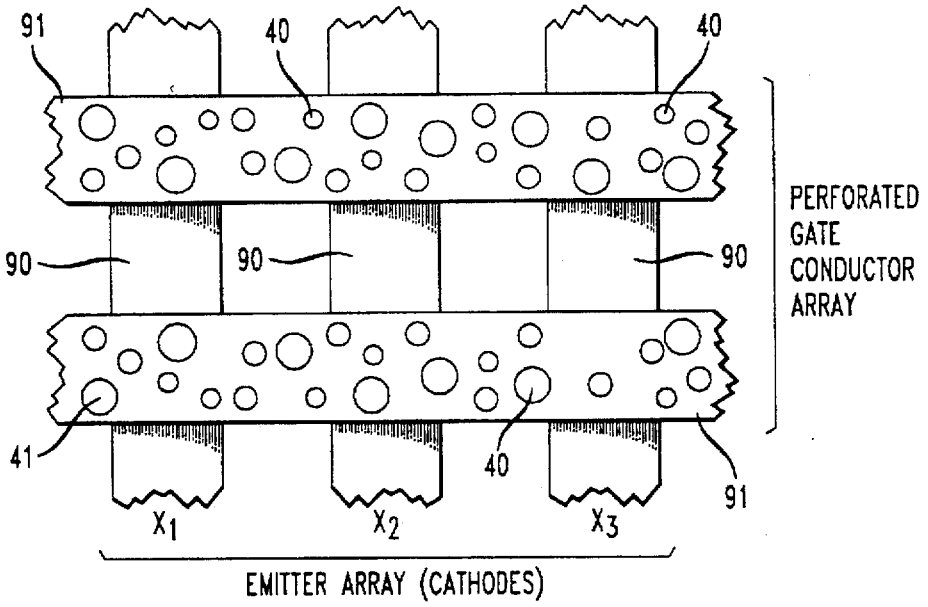
FIG. 9 is a top view showing a grid of emitter regions.

In typical applications the gate electrodes and emitters are deposited in respectively intersecting stripes to define a grid of emitting regions. FIG. 9 illustrates columns 90 of an emitter array and rows 91 of an apertured gate conductor array forming an x-y matrix of emitter regions. These rows and columns can be prepared by low-cost screen printing of emitter material (e.g. in stripes of 100 μm width) and physical vapor deposition of the gate conductor through a strip metal mask with, for example, 100 μm wide parallel gaps. Depending on the activation voltage of a particular column of gate and a particular row of emitter, a specific pixel can be selectively activated at the intersection of column and row to emit electrons.

Figure 10:
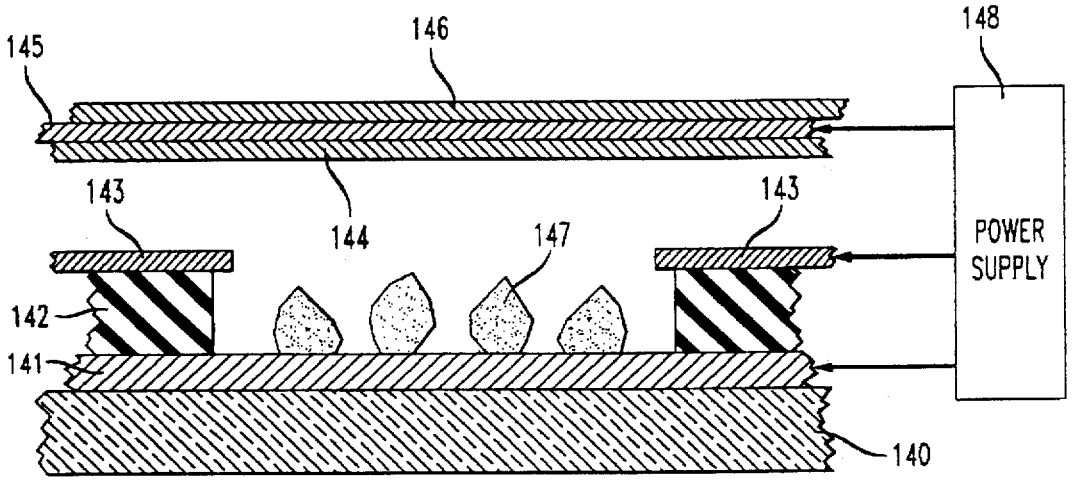
FIG. 10 is a schematic diagram of a field emission flat panel display device employing the field emitters of this invention.

The preferred use of these low voltage emitters is in the fabrication of field emission devices such as electron emission flat panel displays. FIG. 10 is a schematic cross section of an exemplary flat panel display using low voltage particulate emitters. The display comprises a cathode 141 including a plurality of low voltage particulate emitters 147 and an anode 145 disposed in spaced relation from the emitters within a vacuum seal. The anode conductor 145 formed on a transparent insulating substrate 146 is provided with a phosphor layer 144 and mounted on support pillars (not shown). Between the cathode and the anode and closely spaced from the emitters is a perforated conductive gate layer 143. Conveniently the gate 143 is spaced from the cathode 141 by a thin insulating layer 142.

The space between the anode and the emitter is sealed and evacuated, and voltage is applied by power supply 148. The field-emitted electrons from electron emitters 147 are accelerated by the gate electrode 143 from multiple emitters 147 on each pixel and move toward the anode conductive layer 145 (typically transparent conductor such as indium-tin-oxide) coated on the anode substrate 146. Phosphor layer 144 is disposed between the electron emitters and the anode. As the accelerated electrons hit the phosphor, a display image is generated.

While specific embodiments of the present invention are shown and described in this application, the invention is not limited to these particular forms. For example, the low field nanometer diamond emitters can be used not only in flat panel displays but also as a cold cathode in a wide variety of other field emission devices including x-y matrix addressable electron sources, electron guns for electron beam lithography, microwave power amplifiers, ion guns, microscopes, photocopiers and video cameras. The nanometer sizes of diamond can also be extended to micron sizes if suitable methods are found to impart them with sufficient conductivity and emissive surfaces. The invention also applies to further modifications and improvements which do not depart from the spirit and scope of this invention.

We claim:

1. A method for making an electron field emission device comprising the steps of:

providing a substrate;

adhering to said substrate diamond particles having maximum dimensions in the range of 5–10,000 nm;

exposing said diamond particles to a gas mixture containing activated hydrogen at a temperature in excess of 300° C.; and disposing an electrode adjacent said diamond particles.

2. The method of claim 1 wherein said particles have maximum dimensions in the range 10–1,000 nm.

3. The method of claim 1 wherein said gas mixture is a plasma.

4. The method of claim 3 wherein said particles are exposed to said gas mixture at a temperature in excess of 400° C.

5. The method of claim 1 wherein said diamond particles are adhered to said substrate by coating said substrate with a liquid suspension containing said diamond particles.

6. The method of claim 1 wherein said diamond particles are adhered to said substrate by coating said substrate with a slurry containing said diamond particles.

7. The method of claim 1 wherein said diamond particles have maximum dimensions in the range 10 nm to 300 nm.

8. The method of claim 1 wherein said diamonds are exposed to said gas mixture for a period exceeding 30 minutes.

9. The method of claim 1 wherein said diamonds are exposed to said gas mixture for a time sufficient to produce a device having an electron emission current density of at least 0.1 $mA/mm^2$ at field strength below 12 V/μm.

10. The method of claim 1 wherein said substrate has a surface resistant to etching by hydrogen plasma.

11. The method of claim 1 wherein said diamond particles are adhered to said substrate in a single layer with 1% to 60% coverage.

12. An electron field emission device made by the process of claim 1 or 2 or 4 or 5 or 6 or 7 or 8 or 9 or 10 or 11.

* * * * *